US012188459B2

(12) United States Patent
Ikeda et al.

(10) Patent No.: US 12,188,459 B2
(45) Date of Patent: Jan. 7, 2025

(54) VALVE PLATE, CYLINDER BLOCK, AND HYDRAULIC PUMP/MOTOR

(71) Applicant: Komatsu Ltd., Tokyo (JP)

(72) Inventors: Mitsutaka Ikeda, Tokyo (JP); Hiroaki Motoshima, Tokyo (JP)

(73) Assignee: Komatsu Ltd., Tokyo (JP)

( * ) Notice: Subject to any disclaimer, the term of this patent is extended or adjusted under 35 U.S.C. 154(b) by 54 days.

(21) Appl. No.: 18/018,655

(22) PCT Filed: Sep. 7, 2021

(86) PCT No.: PCT/JP2021/032893

§ 371 (c)(1),
(2) Date: Jan. 30, 2023

(87) PCT Pub. No.: WO2022/054807

PCT Pub. Date: Mar. 17, 2022

(65) Prior Publication Data

US 2023/0304481 A1 Sep. 28, 2023

(30) Foreign Application Priority Data

Sep. 14, 2020 (JP) ..... 2020-154112

(51) Int. Cl.
*F04B 1/20* (2020.01)
*F04B 1/2021* (2020.01)

(52) U.S. Cl.
CPC ..... *F04B 1/2021* (2013.01)

(58) Field of Classification Search
CPC .... F03C 1/0636; F03C 1/0647; F03C 1/0655; F04B 1/2021
See application file for complete search history.

(56) References Cited

U.S. PATENT DOCUMENTS 10,018,174 B2 * 7/2018 Iida ..... F04B 1/2035
10,519,990 B2 * 12/2019 Owada ..... E02F 9/2235

FOREIGN PATENT DOCUMENTS

| | | | |
|---|---|---|---|
| DE | 102012105302 A1 | | 12/2013 |
| JP | S46-7854 B1 | | 2/1971 |
| JP | H04-49670 U | | 4/1992 |
| JP | 2003-161268 A | | 6/2003 |
| JP | 2005-220789 A | | 8/2005 |
| JP | 2010-116813 A | | 5/2010 |
| JP | 2018168778 A | * | 11/2018 |

OTHER PUBLICATIONS

Nov. 1, 2018.*

* cited by examiner

*Primary Examiner* — Abiy Teka
(74) *Attorney, Agent, or Firm* — Locke Lord LLP

(57) ABSTRACT

A valve plate of a hydraulic pump/motor, includes a high pressure-side port and a low pressure-side port, a first oil groove provided to be endless in an outer peripheral part of the high and low pressure-side ports, and a plurality of second oil grooves. Further, a plurality of pad oil grooves communicating with the first oil groove and opened toward the end face of the cylinder block is provided in an outer peripheral portion of the high pressure-side port, at least in a portion being on a downstream side of the relative rotation, in a pad region contacting the end face of the cylinder block, and the plurality of pad oil grooves is provided such that a proportion of an opening area to the end face of the cylinder block is larger on the downstream side than on an upstream side of the relative rotation.

14 Claims, 16 Drawing Sheets

VALVE PLATE, CYLINDER BLOCK, AND HYDRAULIC PUMP/MOTOR

FIELD

The present disclosure relates to a valve plate, a cylinder block, and a hydraulic pump/motor.

BACKGROUND

Some hydraulic pumps/motors of this type include an annular oil groove and a plurality of radial oil grooves provided between a valve plate and an end face of the cylinder block. The annular oil groove is a cavity configured in an endless annular shape at an outer peripheral portion with respect to a high pressure-side port and a low pressure-side port in the valve plate. The radial oil groove extends from the annular oil groove along the radial direction to the outer periphery, and is provided at a plurality of places at equal intervals. In this hydraulic pump/motor, oil between the valve plate and the end face of the cylinder block is discharged into the case via the annular oil groove and the radial oil grooves. For this reason, there is a concern that it is difficult to maintain an oil film between the valve plate and the end face of the cylinder block in a region (hereinafter, referred to as a pad region) that is an outer periphery with respect to the annular oil groove. In order to solve such a problem, in the related art, there are also provided those in which an oil reservoir is formed in an outer peripheral portion with respect to an annular oil groove to lubricate a pad region (see, for example, Patent Literature 1).

CITATION LIST

Patent Literature

Patent Literature 1: Japanese Laid-open Patent Publication No. 2010-116813

SUMMARY

Technical Problem

Meanwhile, recent hydraulic pumps/motors have been demanded to increase the pressure and speed. In a hydraulic pump/motor with high pressure and high speed, it is difficult to maintain an oil film in a pad region even when the above-described oil reservoir is provided, and there is a possibility that problems such as seizure and galling occur between the valve plate and the end face of the cylinder block.

In view of the above circumstances, an object of the present invention is to provide a valve plate, a cylinder block, and a hydraulic pump/motor capable of preventing problems such as seizure and galling from occurring between the valve plate and the end face of the cylinder block even under high pressure and high speed conditions.

Solution to Problem

To attain the above object, a valve plate of a hydraulic pump/motor according to the present disclosure, includes a high pressure-side port and a low pressure-side port on a circumference about a rotation axis, a first oil groove provided to be endless in an outer peripheral part with respect to the high pressure-side port and the low pressure-side port, and a plurality of second oil grooves extending from the first oil groove toward an outer periphery, the high pressure-side port and the low pressure-side port being alternately communicated with a cylinder bore provided in a cylinder block by relative rotation about the rotation axis in a state of being in contact with an end face of the cylinder block. Further, a plurality of pad oil grooves communicating with the first oil groove and opened toward the end face of the cylinder block is provided in an outer peripheral portion of the high pressure-side port, at least the portion being on a downstream side of the relative rotation, in a pad region contacting the end face of the cylinder block between the second oil grooves, and the plurality of pad oil grooves is provided such that a proportion of an opening area to the end face of the cylinder block is larger on the downstream side than on an upstream side of the relative rotation.

Advantageous Effects of Invention

According to the present disclosure, since the oil in a first oil groove is supplied to the pad region through a pad oil groove, the oil film is secured between the valve plate and the end face of the cylinder block even when the pressure and speed are increased, and it is possible to prevent problems such as seizure and galling from occurring. Moreover, the pad oil groove is provided such that the proportion of the opening area to the end face of the cylinder block is larger on the downstream side of the relative rotation where the oil from a second oil groove does not easily reach than on the upstream side of the relative rotation where the oil from the second oil groove easily reaches. In other words, a sliding portion with the cylinder block is secured in a portion on the upstream side of the relative rotation in the pad region. Therefore, there is no concern that the rotation of the cylinder block becomes unstable due to the provision of the pad oil groove, and high pressure and high speed can be realized.

DESCRIPTION OF EMBODIMENTS

Hereinafter, preferred embodiments of a valve plate, a cylinder block, and a hydraulic pump/motor according to the present disclosure will be described in detail with reference to the accompanying drawings.

First Embodiment

Figure 1A:
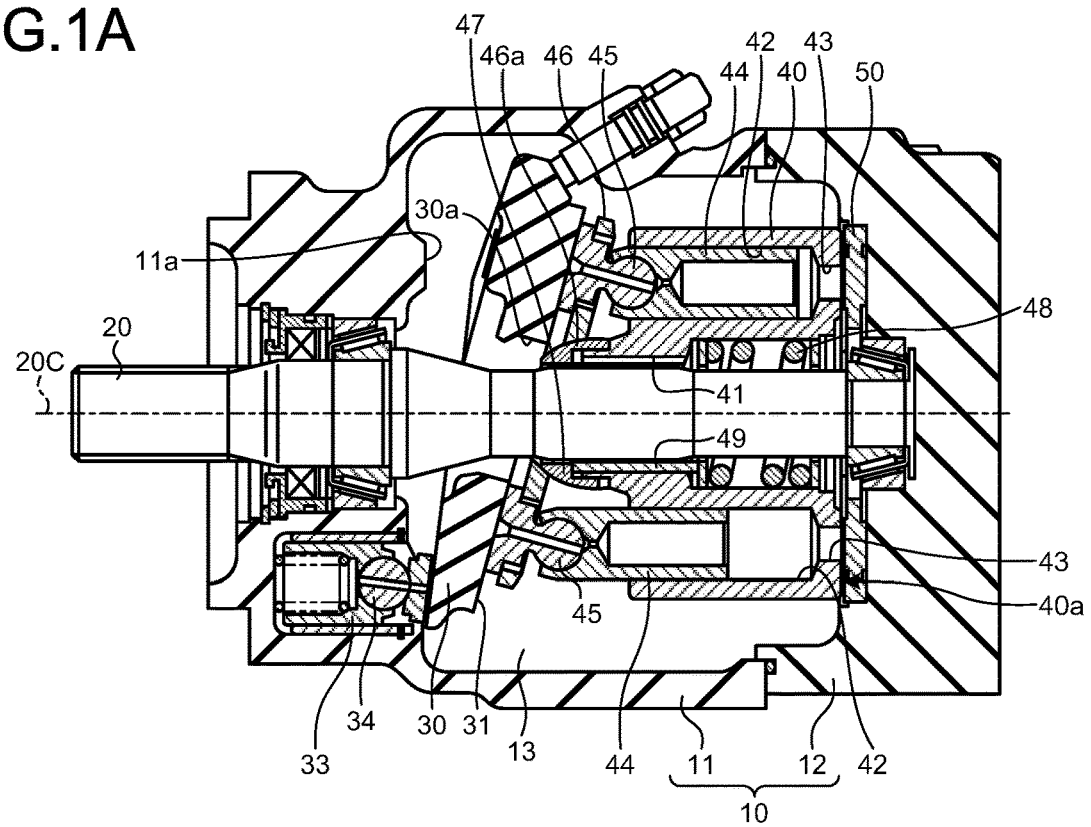
FIG. 1A illustrates a hydraulic pump/motor of a first embodiment of the present disclosure, and is a cross-sectional diagram cut along a plane including a rotation axis in a state where a high pressure-side region is above.
Figure 1B:
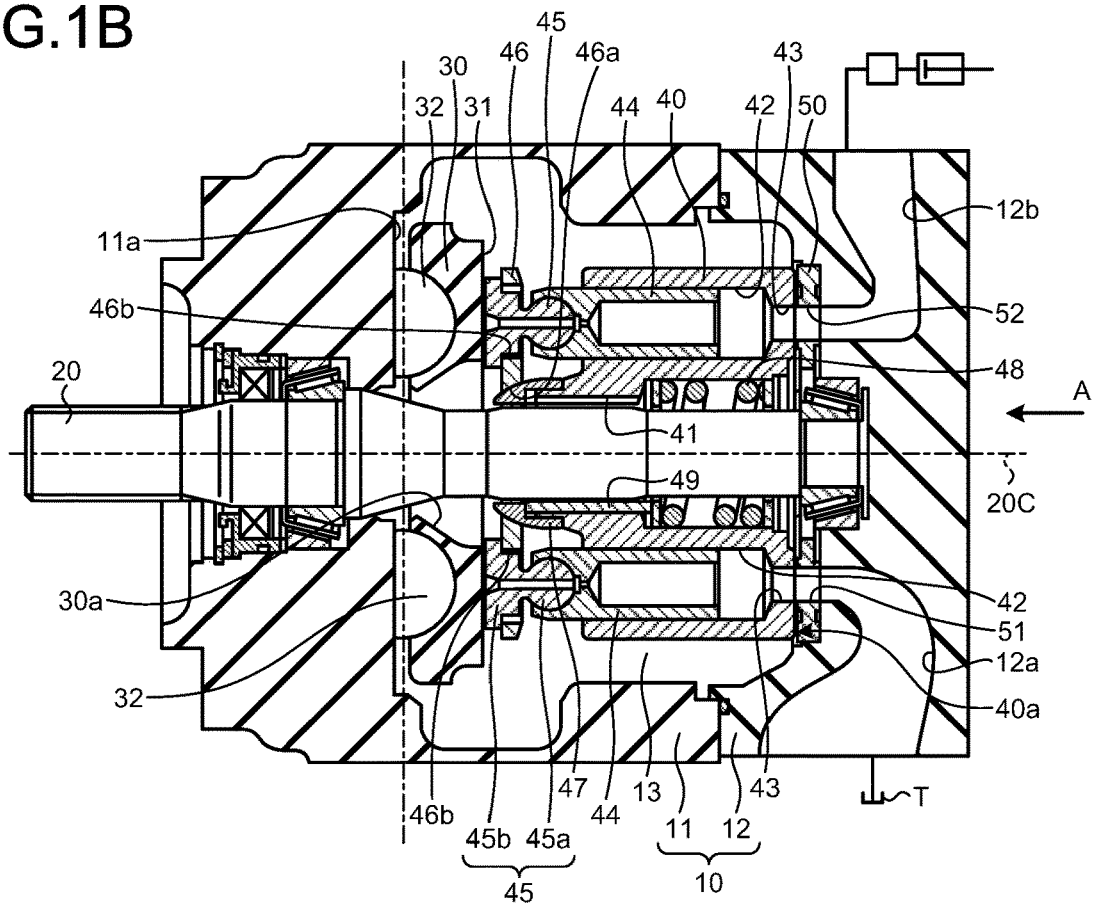
FIG. 1B illustrates a hydraulic pump/motor of the first embodiment of the present disclosure, and is a cross-sectional diagram cut along a plane including a rotation axis and orthogonal to the cutting plane of FIG. 1A.

FIGS. 1A and 1B illustrate a hydraulic pump/motor of a first embodiment of the present disclosure. The hydraulic pump/motor exemplified here is of an axial type that operates as a hydraulic pump when power is given from the outside, and includes an input/output shaft 20 inside a case 10. The case 10 includes a case body 11 and a port block 12, and constitutes a housing chamber 13 therebetween. The input/output shaft 20 is a columnar member disposed so as to cross the housing chamber 13 of the case 10, and has one end rotatably supported by the case body 11 and the other end rotatably supported by the port block 12. One end of the input/output shaft 20 protrudes to the outside of the case body 11 as an input end that receives power from a power source such as an engine. The other end of the input/output shaft 20 terminates inside the port block 12. The input/output shaft 20 is provided with a swash plate 30 and a cylinder block 40 on the outer periphery of a portion housed in the housing chamber 13.

The swash plate 30 is a plate-shaped member having a flat sliding surface 31 on a side facing the port block 12, and is disposed at a position close to an inner wall surface 11*a* of the case body 11 in a state where the input/output shaft 20 penetrates an opening 30*a* provided at a central part. The swash plate 30 is supported on the inner wall surface 11*a* of the case body 11 via two ball retainers 32 having a substantially hemispherical shape, and can tilt the sliding surface 31 with respect to the input/output shaft 20. Reference numeral 33 in the drawings denotes a servo device provided on the case body 11. The servo device 33 is a hydraulic cylinder that is movable along an axis of the input/output shaft 20 and contacts the swash plate 30 via a tilting member 34. When the servo device 33 is extended and contracted by hydraulic pressure such as pilot pressure or self-discharge pressure, the swash plate 30 moves along the spherical surface of the ball retainers 32, and the inclination angle of the swash plate 30 with respect to the axis of the input/output shaft 20 can be changed.

Figure 2A:
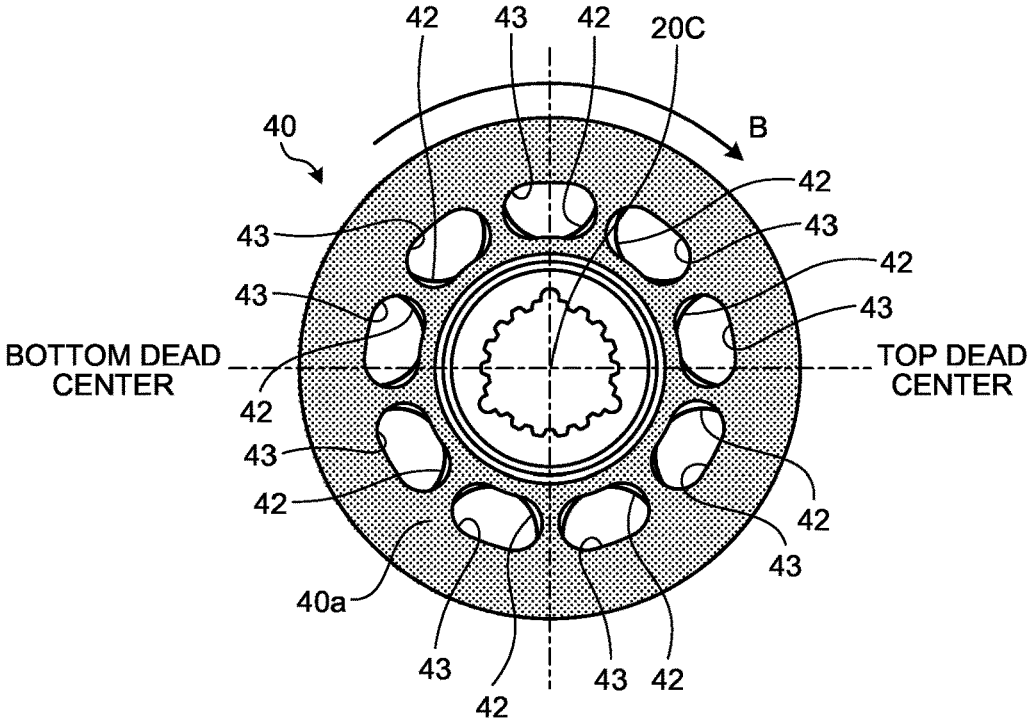
FIG. 2A illustrates components of the hydraulic pump/motor illustrated in FIGS. 1A and 1B, and is an end face diagram of a cylinder block as viewed from an arrow A in FIG. 1B.

The cylinder block 40 is a cylindrical member having a center hole 41, and is disposed between the port block 12 and the swash plate 30 in a state where the input/output shaft 20 penetrates the center hole 41. A spline is provided between the center hole 41 of the cylinder block 40 and the outer peripheral surface of the input/output shaft 20 so that the cylinder block 40 rotates integrally with the input/output shaft 20. In the hydraulic pump of the present first embodiment, as illustrated in FIG. 2A, which is indicated by an arrow A in FIG. 1B, when the cylinder block 40 is viewed from the port block 12 side, the cylinder block 40 is configured to rotate clockwise (reference sign B in FIG. 2B) about a rotation axis 20C of the input/output shaft 20.

In the cylinder block 40, a plurality of cylinder bores 42 is formed on the circumference about the rotation axis 20C of the input/output shaft 20. The cylinder bores 42 are cylindrical cavities formed so as to be parallel to the rotation axis 20C of the input/output shaft 20, and are arranged at equal intervals along the circumferential direction. As illustrated in FIG. 2A, in the present first embodiment, nine cylinder bores 42 are provided in the cylinder block 40. Each of the cylinder bores 42 opens to an end face facing the swash plate 30, while an end close to the port block 12 terminates inside the cylinder block 40 and opens to an end face 40*a* of the cylinder block 40 via a communication port 43 having a reduced cross-sectional area.

As illustrated in FIGS. 1A and 1B, a piston 44 is disposed in each of the cylinder bores 42 of the cylinder block 40. The piston 44 has a columnar shape with a circular cross section, and is fitted in the cylinder bore 42 in a state of being movable along the axis. A piston shoe 45 is provided at an end of each piston 44 facing the swash plate 30. The piston shoe 45 is configured to be tiltable with respect to the piston 44 and slidable with respect to the sliding surface 31 of the swash plate 30. In the present first embodiment, an example in which the piston shoe 45 has a spherical portion 45*a* and a sliding portion 45*b*, and is tiltably supported at a tip portion of each piston 44 via the spherical portion 45*a* is illustrated. As a configuration for tiltably supporting the piston shoe 45 with respect to the piston 44, the spherical portion may be provided at an end of the piston 44.

Each of the piston shoes 45 is pressed against the sliding surface 31 of the swash plate 30 via a pressing plate 46. The pressing plate 46 is a flat plate-shaped member having substantially the same outer diameter as the cylinder block 40, has a pressing hole 46*a* at the center portion, and has a mounting hole 46*b* at a portion corresponding to each piston 44. The mounting hole 46*b* is an opening having an inner diameter through which the spherical portion 45*a* can be inserted and the sliding portion 45*b* cannot be inserted. The pressing plate 46 is disposed between the cylinder block 40 and the swash plate 30 in a state where the input/output shaft 20 penetrates the pressing hole 46*a* and the piston shoes 45 are inserted into the respective mounting holes 46*b*.

The pressing hole 46*a* formed in the pressing plate 46 has an inner peripheral surface having a spherical shape, and includes a retainer guide 47 therein. The retainer guide 47 is formed in a hemispherical shape having an outer diameter fitted into the pressing hole 46*a* of the pressing plate 46, and is disposed between the pressing plate 46 and the cylinder block 40 in a state where the input/output shaft 20 penetrates the center portion thereof and the spherical part contacts the pressing hole 46*a* of the pressing plate 46. The retainer guide 47 and the outer peripheral surface of the input/output shaft 20 are joined by a spline such that the retainer guide 47 rotates integrally with the input/output shaft 20 and is movable along the rotation axis 20C of the input/output shaft 20. A pressing force of a pressing spring 48 incorporated in the center portion of the cylinder block 40 is constantly applied to the retainer guide 47 via a transmission rod 49. The pressing force of the pressing spring 48 applied to the retainer guide 47 is applied to the piston shoe 45 via the pressing plate 46, and acts to constantly bring each of the sliding portions 45*b* of the piston shoes 45 into contact with the sliding surface 31 of the swash plate 30.

Figure 2B:
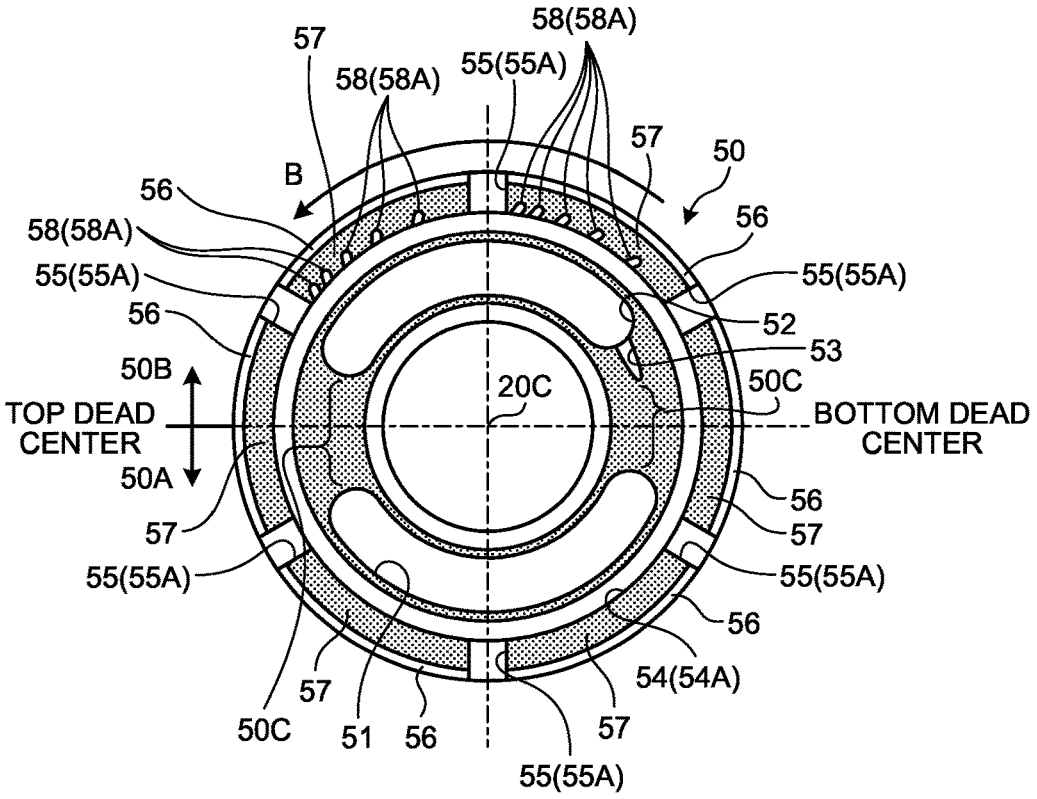
FIG. 2B illustrates components of the hydraulic pump/motor illustrated in FIGS. 1A and 1B, and is an end face diagram illustrating a contact surface of a valve plate with a cylinder block.

On the other hand, in the port block 12, a valve plate 50 is provided at a portion facing the communication ports 43 of the cylinder block 40. As illustrated in FIG. 2B, the valve plate 50 is a circular plate-shaped member having a suction port 51 (low pressure-side port) and a discharge port (high pressure-side port) 52. The valve plate 50 slidably contacts the end face 40*a* of the cylinder block 40 in a state where the communication ports 43 of the cylinder block 40 can alternately communicate with the suction port 51 and the discharge port 52. That is, the suction port 51 and the discharge port 52 are through-holes provided on the same circumference about on the rotation axis 20C of the input/output shaft 20, and each have an arc shape. In the above example, the suction port 51 is provided so that the plurality of communication ports 43 simultaneously communicates with a low pressure-side region 50A where the pistons 44 move from the top dead center to the bottom dead center in the valve plate 50. In a high pressure-side region 50B where the pistons 44 move from the bottom dead center to the top dead center, the discharge port 52 is provided so that the plurality of communication ports 43 communicates simultaneously. Between the suction port 51 and the discharge port 52, closing regions 50C for closing the communication ports 43 of the cylinder bores 42 where the pistons 44 are located at the top dead center and the bottom dead center are secured. As illustrated in FIG. 1B, the suction port 51 communicates with a suction passage 12*a* formed in the port block 12, and is connected to an oil tank T through the suction passage 12*a*. The discharge port 52 is connected to a discharge passage 12*b* formed in the port block 12. Reference numeral 53 in FIG. 2B denotes a notch provided at a bottom dead center-side end of the discharge port 52. Note that, in the drawings, for the sake of convenience, a dot is provided at a contact part between the cylinder block 40 and the valve plate 50.

Further, the valve plate 50 is provided with an annular oil groove (first oil groove) 54 and a plurality of radial oil grooves (second oil grooves) 55. The annular oil groove 54 is an endless annular recess provided in an outer peripheral portion with respect to the suction port 51 and the discharge port 52. The annular oil groove 54 has, for example, a substantially semicircular cross section with a constant radius, and is open only on a surface facing the end face 40*a* of the cylinder block 40. The radial oil grooves 55 are linear recesses extending from the annular oil groove 54 toward the outer periphery, and are formed at equal interval positions along the circumferential direction. The radial oil grooves 55 have, for example, a substantially semicircular cross section with a constant radius, are open on a surface facing the end face 40*a* of the cylinder block 40, and have outer peripheral side ends open on the outer peripheral surface of the valve plate 50. In the present first embodiment, the six radial oil grooves 55 are formed radially along a radial r direction about the rotation axis 20C in outer peripheral side portions with respect to the annular oil groove 54. In particular, in the illustrated example, three radial oil grooves 55 are provided to be symmetric with each other in each of the high pressure-side region 50B and the low pressure-side region 50A. The outermost peripheral portions of the radial oil grooves 55 communicate with each other by an outermost peripheral groove 56 extending in the circumferential direction.

Figure 3A:
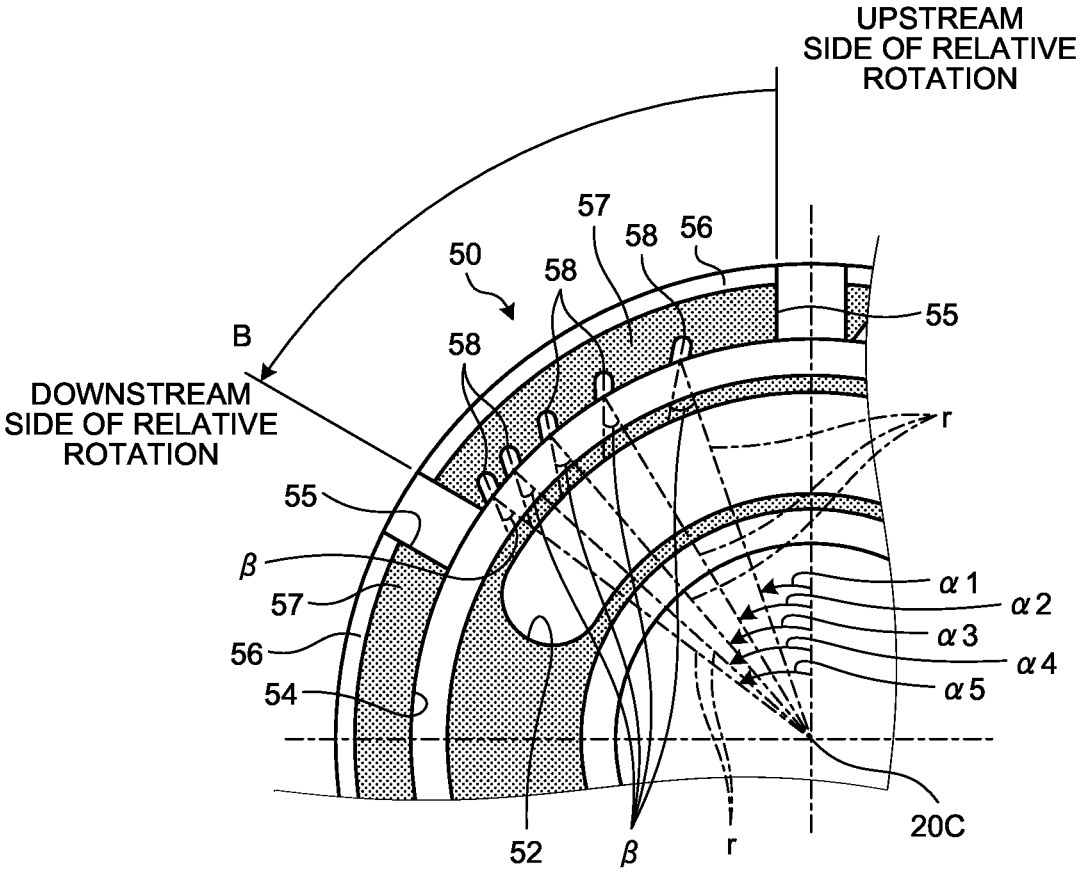
FIG. 3A is an enlarged diagram of a main part of the valve plate illustrated in FIG. 2B, and is an enlarged diagram of a portion of approximately ¼.
Figure 3B:
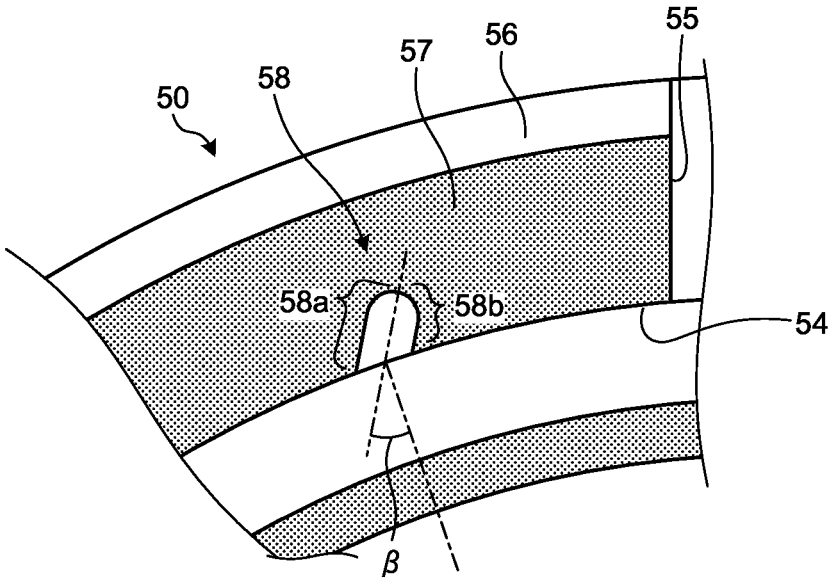
FIG. 3B is an enlarged diagram of a main part of the valve plate illustrated in FIG. 2B, and is an enlarged diagram of a pad region and a pad oil groove.

Furthermore, in the valve plate 50, as illustrated in FIGS. 2B, 3A, and 3B, pad oil grooves 58 are provided in a pad region 57 formed between the radial oil grooves 55 in an outer peripheral portion with respect to the annular oil groove 54. The pad oil grooves 58 are linear recesses having one end communicating with the annular oil groove 54 and the other end closed, and a plurality of pad oil groove 58 is formed only in two pad regions 57 located on the outer periphery of the discharge port 52. The pad oil grooves 58 have, for example, a substantially semicircular cross section with a constant radius, are opened on a surface facing the end face 40*a* of the cylinder block 40, have a width smaller than that of the radial oil grooves 55, and are provided between the annular oil groove 54 and a portion that is approximately ½ of the dimension along the radial direction of the pad region 57. As is clear from the drawings, the plurality of pad oil grooves 58 is arranged at unequal pitches such that a mutual interval gradually decreases toward the downstream side in the case of relative rotation with respect to the cylinder block 40. Specifically, in the example of FIG. 3A, the pad oil groove 58 is arranged at a total of five positions of $\alpha 1$=about 18.1°, $\alpha 2$=about 30.1°, $\alpha 3$=about 39.6°, $\alpha 4$=about 46.8°, and $\alpha 5$=about 51.6° from the radial oil groove 55 located on the upstream side of the relative rotation with respect to the pad region 57. Thus, the proportion of the opening area of the pad oil groove 58 to the end face 40*a* of the cylinder block 40 is larger in the portion on the downstream side than in the portion on the upstream side in the case of the relative rotation of the cylinder block 40.

Furthermore, each of the pad oil grooves 58 is inclined with respect to the radial r direction about the rotation axis 20C. In the illustrated example, the pad oil grooves 58 are inclined so as to be on the upstream side of the rotation gradually toward the outer periphery. Inclination angles β of the pad oil grooves 58 are the same as each other, and are set to about 30° with respect to the radial r direction about the rotation axis 20C. As is clear from FIG. 3B, in the pad oil groove 58 inclined with respect to the radial r direction, the length of a side 58*a*, which is an outer peripheral side of the rotation, is larger than the length of a side 58*b*, which is an inner peripheral side close to the annular oil groove 54.

In the hydraulic pump configured as described above, as illustrated in FIGS. 1A to 3B, when the input/output shaft 20 is rotated with respect to the case 10, the cylinder block 40 rotates integrally with the input/output shaft 20, and the piston 44 contacting the sliding surface 31 of the swash plate 30 via the piston shoe 45 moves in a stroke with respect to the cylinder bore 42. Thus, in the low pressure-side region 50A, the piston 44 moves in a stroke so as to protrude from the cylinder bore 42 of the cylinder block 40 (moves to the left side in FIG. 1A), and the oil in the oil tank T is sucked into the cylinder bore 42 via the suction passage 12*a* and the suction port 51 of the valve plate 50. On the other hand, in the high pressure-side region 50B, the piston 44 moves in a stroke so as to enter the cylinder bore 42 of the cylinder block 40 (moves to the right side in FIG. 1A), and the oil in the cylinder bore 42 is discharged to a hydraulic device such as a hydraulic cylinder via the discharge port 52 of the valve plate 50 and the discharge passage 12*b*. When hydraulic pressure such as pilot pressure or discharge pressure from the discharge port 52 is supplied to the servo device 33 and the inclination angle of the swash plate 30 is changed accordingly, the stroke distance of the piston 44 as a result of the rotation of the cylinder block 40 changes, and the flow rate of the oil discharged through the discharge passage 12*b* is changed.

Between the cylinder block 40 and the valve plate 50, the end face 40*a* of the cylinder block 40 contacts the valve plate 50, whereby the annular oil groove 54 constitutes an endless annular oil passage 54A with respect to the cylinder block 40. Similarly, between the cylinder block 40 and the valve plate 50, a plurality of radial oil passages 55A opened from the endless annular oil passage 54A to the housing chamber 13 is formed by the radial oil grooves 55 with respect to the cylinder block 40. Therefore, while the end face 40*a* of the cylinder block 40 and the valve plate 50 are relatively sliding, the oil leaking from the communication ports 43 lubricates between the cylinder block 40 and the valve plate 50, and is then discharged to the housing chamber 13 via the endless annular oil passage 54A and the radial oil passages 55A. Further, a part of the oil passing through the radial oil passages 55A reaches the pad region 57 as a result of the rotation of the cylinder block 40 and lubricates between the cylinder block 40 and the valve plate 50. Therefore, a sufficient oil film can be secured even when the pressure and speed are increased in an inner peripheral side portion with respect to the endless annular oil passage 54A and a portion close to the radial oil passage 55A on the upstream side of the relative rotation in the pad region 57. Thus, there is no possibility that problems such as seizure and galling caused by oil shortage occur.

On the other hand, the oil from the radial oil passages 55A hardly reaches the portion on the downstream side of the relative rotation in the pad region 57. In particular, in the outer peripheral portion of the discharge port 52 on the high pressure side, there is a concern that it is difficult to sufficiently secure the oil film only by the oil passing through the radial oil passages 55A. However, in the above-described hydraulic pump, the pad oil grooves 58 are provided in a portion on the downstream side of the relative rotation in the pad region 57. When the cylinder block 40 contacts the valve plate 50, the pad oil grooves 58 constitute pad oil passages 58A that communicate the endless annular oil passage 54A with the portion on the downstream side of the relative rotation in the pad region 57. Thus, the oil in the endless annular oil passage 54A is supplied to the portion on the downstream side of the relative rotation in the pad region 57 through the pad oil passages 58A. Therefore, even when the hydraulic pump is increased in pressure and speed, there is no possibility of causing oil shortage in the portion where the end face 40*a* of the cylinder block 40 and the valve plate 50 relatively slide, and there is no concern that problems such as seizure and galling occur. Moreover, regarding the pad region 57 which the outer peripheral portion of the cylinder block 40 contacts, the pad oil grooves 58 are formed only on the outer peripheral portion of the discharge port 52 on the high pressure side. Furthermore, the pad oil grooves 58 are provided such that the proportion of the opening area to the end face 40*a* of the cylinder block 40 is larger on the downstream side than on the upstream side of the relative rotation. For this reason, a contact part with the cylinder block 40 can be secured in the pad region 57 other than the outer peripheral portion of the discharge port 52 and the portion on the upstream side of the relative rotation in the pad region 57 located on the outer periphery of the discharge port 52. As a result, there is no concern that the rotation of the cylinder block 40 becomes unstable due to the provision of the pad oil grooves 58, and high pressure and high speed of the hydraulic pump can be realized.

Note that, in the first embodiment described above, the example in which the inclination angle of the swash plate 30 can be changed is illustrated, but it is not always necessary to be capable of changing the inclination angle of the swash plate 30. Further, although the cylinder block 40 is provided with nine cylinder bores 42 as an example, the number of cylinder bores 42 is not limited thereto. Furthermore, an example in which six radial oil grooves 55 are linearly provided is illustrated, but the shape and number of radial oil grooves 55 are not limited to those of the first embodiment.

Further, in the first embodiment described above, the pad oil grooves 58 are also provided in a portion on the upstream side of the relative rotation with respect to an intermediate position in the circumferential direction in the pad region 57, but the present disclosure is not limited thereto. It is sufficient that the pad oil grooves 58 are provided only in a portion on the downstream side of the relative rotation with respect to the intermediate position in the circumferential direction in the pad region 57.

Furthermore, in the above-described first embodiment, the pad oil grooves 58 are inclined with respect to the radial r direction about the rotation axis 20C so as to be on the upstream side of the relative rotation gradually toward the outer periphery. Thus, the length of a side 58*a* on the outer peripheral side of the rotation in the pad oil groove 58 becomes larger than the length of a side 58*b* on the inner peripheral side. Therefore, even under a situation where the cylinder block 40 rotates at a relatively low speed such as 1000 rpm, the amount of oil supplied to the pad region 57 can be secured from the portion of the side 58*a* on the outer peripheral side in the pad oil passage 58A, which is advantageous in terms of lubricity. However, the extension direction of the pad oil grooves 58 is not limited thereto, and the pad oil grooves 58 may be provided along the radial r direction about the rotation axis 20C. Further, when the pad oil grooves 58 are inclined with respect to the radial r direction about the rotation axis 20C, it can be configured as in a first modification illustrated in FIGS. 4 and 5 and a second modification illustrated in FIGS. 6 and 7.

Figure 4:
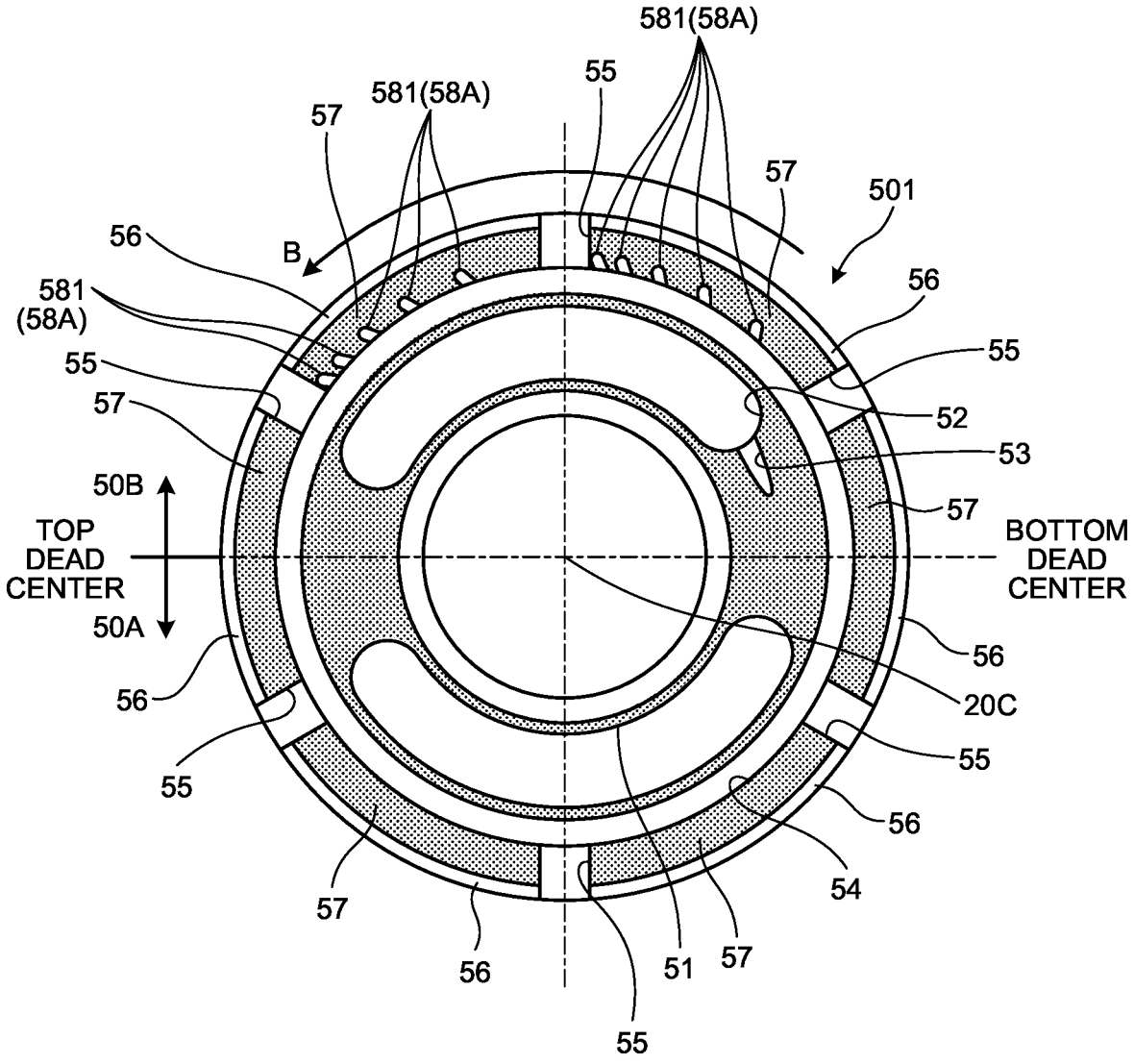
FIG. 4 is an end face diagram of a valve plate of a first modification.
Figure 5:
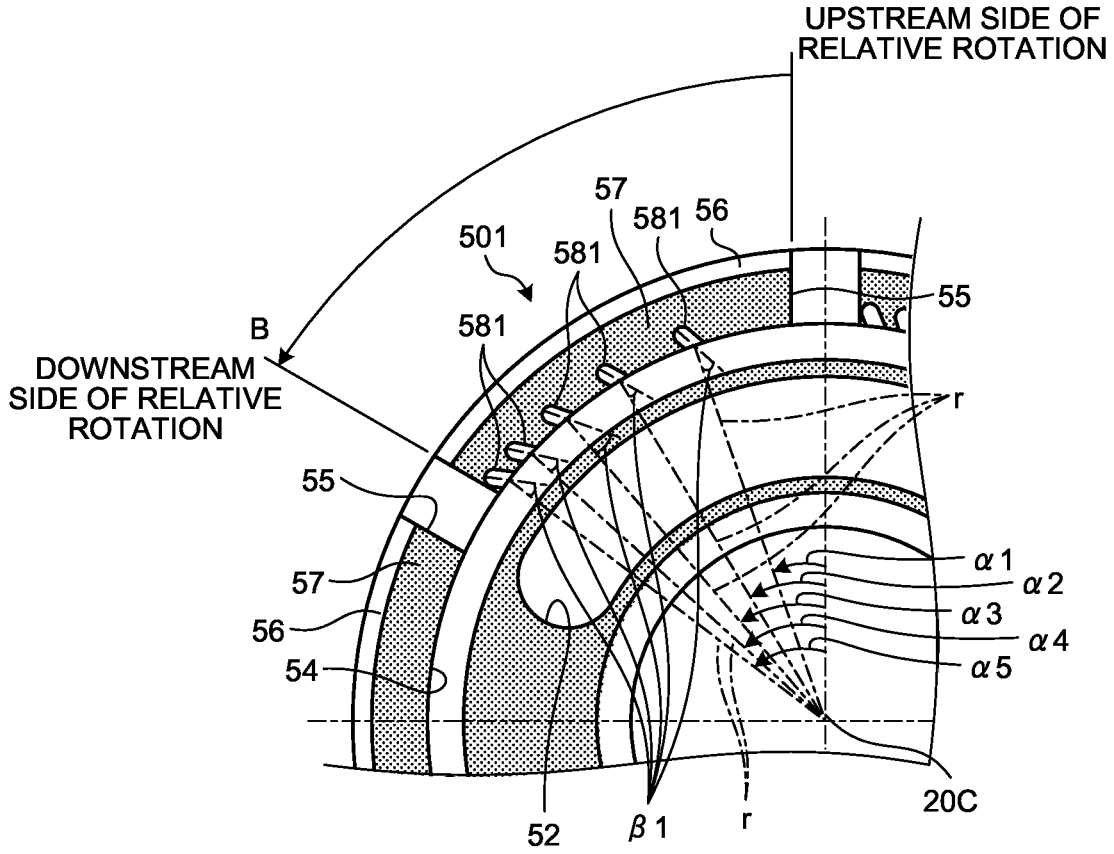
FIG. 5 is an enlarged diagram of a main part of the valve plate illustrated in FIG. 4.

That is, in a valve plate 501 of the first modification illustrated in FIGS. 4 and 5, pad oil grooves 581 are inclined so as to be downstream of the relative rotation gradually toward the outer periphery. Inclination angles β1 of the pad oil grooves 581 with respect to the radial r direction about the rotation axis 20C are about 30° in the direction opposite to that in the first embodiment. The pitch at which the pad oil grooves 581 are formed is similar to that in the first embodiment. According to the first modification, the pad oil grooves 581 are inclined with respect to the radial r direction about the rotation axis 20C so as to be on the downstream side of the relative rotation gradually toward the outer periphery. For this reason, a side of the pad oil groove 581 on the downstream side of the relative rotation is located on the inner peripheral side. Therefore, since the oil supplied from the pad oil passages 58A to the inner peripheral side of the pad region 57 reaches the outer periphery while flowing around, the path of the oil passing through the pad region 57 becomes long. Thus, even under a situation where the cylinder block 40 rotates at a relatively high speed exceeding 2300 rpm, the amount of oil supplied to the pad region 57 can be secured from the pad oil passages 58A, which is advantageous in terms of lubricity. Note that, in the first modification, the same configurations as those of the first embodiment are denoted by the same reference numerals. Further, as in the first embodiment, a dot is provided at a contact part of the valve plate 501 with the cylinder block 40.

Figure 6:
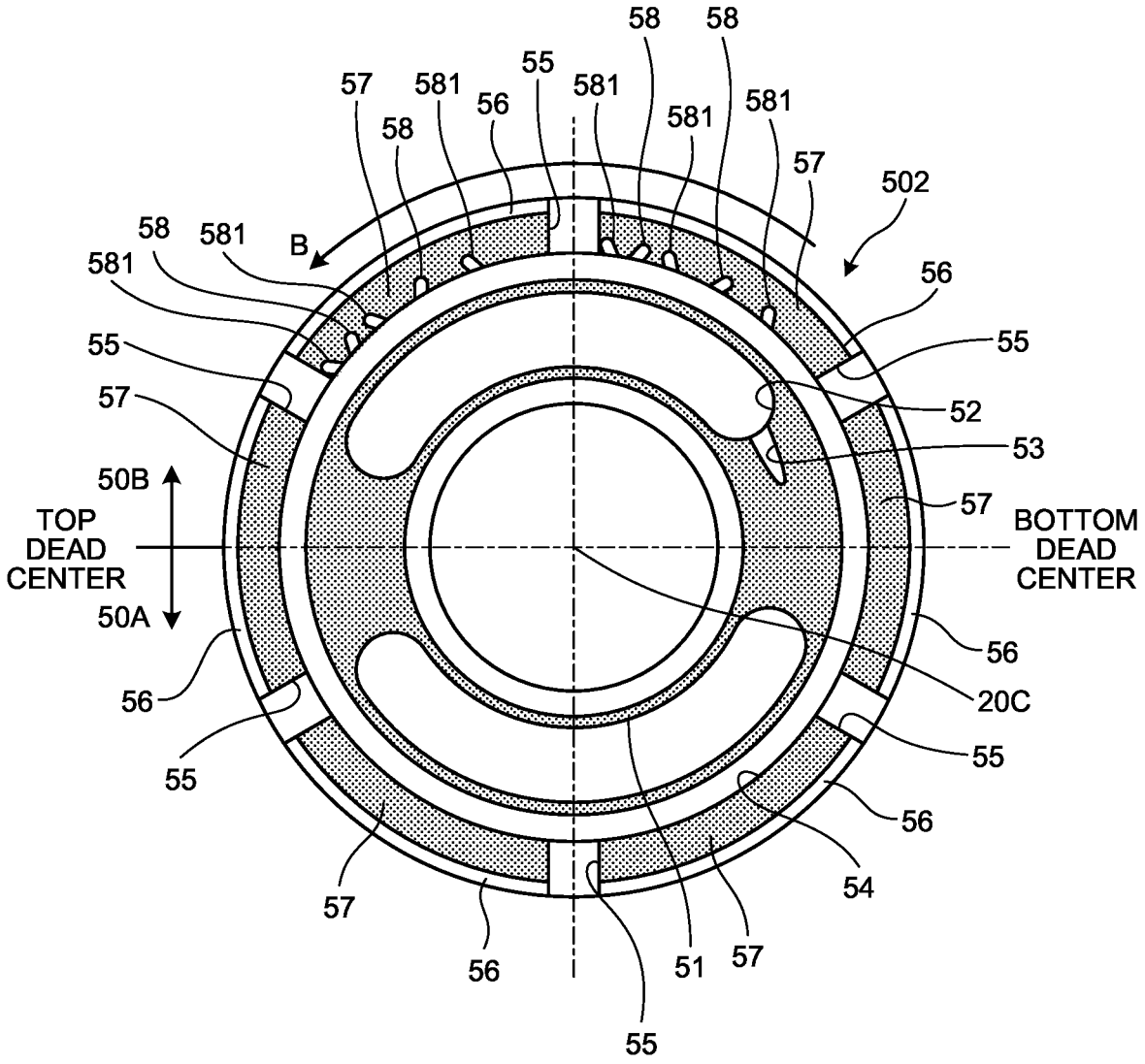
FIG. 6 is an end face diagram of a valve plate of a second modification.
Figure 7:
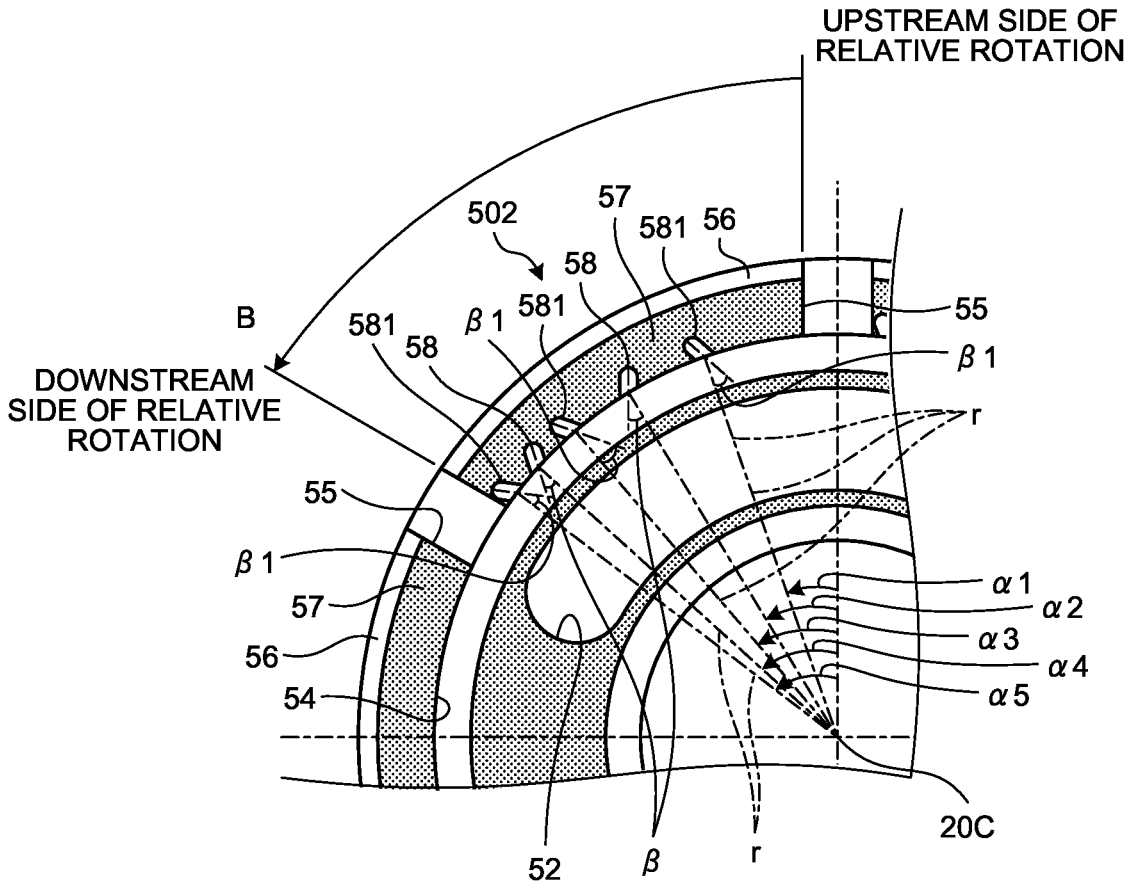
FIG. 7 is an enlarged diagram of a main part of the valve plate illustrated in FIG. 6.

In a valve plate 502 of the second modification illustrated in FIGS. 6 and 7, a pad oil groove 58 on the upstream of the relative rotation gradually toward the outer periphery and a pad oil groove 581 on the downstream of the relative rotation gradually toward the outer periphery are alternately provided. According to the second modification, lubricity can be improved in both relatively low speed rotation advantageous in the first embodiment and relatively high speed rotation advantageous in the first modification. Note that, in the second modification, the same configurations as those of the first embodiment and the first modification are denoted by the same reference numerals. Further, as in the first embodiment, a dot is provided at a contact part of the valve plate 502 with the cylinder block 40.

Figure 8:
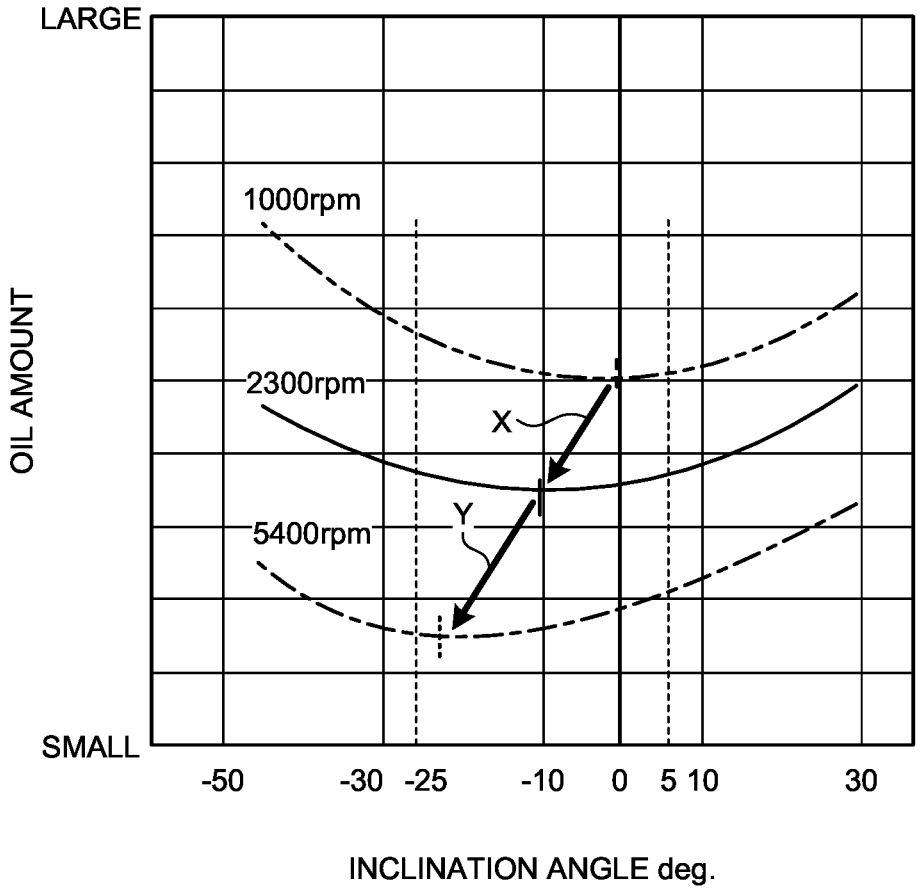
FIG. 8 is a graph illustrating a relationship between an inclination angle of a pad oil groove with respect to a rotation rate region of a cylinder block and an oil amount in the pad region.

FIG. 8 illustrates a relationship between the inclination angles of the pad oil grooves 58 and 581 with respect to a rotation rate region of the cylinder block 40 and an oil amount in the pad region 57. The inclination angle is 0° in the radial r direction about the rotation axis 20C. When the outer peripheral side end is inclined to the upstream side of the relative rotation as in the first embodiment, it is indicated as "−", and when the outer peripheral side end is inclined to the downstream side of the relative rotation as in the first modification, it is indicated as "+". As indicated by a two-dot chain line in FIG. 8, when the cylinder block 40 rotates at a relatively low speed of about 1000 rpm, the pad oil grooves 58 and 581 are preferably inclined with respect to the radial r direction about the rotation axis 20C at an angle excluding the range of +5° to −10°. On the other hand, as indicated by a solid line or a one-dot chain line in FIG. 8, when the cylinder block 40 rotates at a relatively high speed of about 2300 rpm (solid line), 5400 rpm (one-dot chain line), or the like, the pad oil grooves 58 and 581 are preferably inclined with respect to the radial r direction about the rotation axis 20C at an angle excluding the range of +5° to −25°. That is, as indicated by arrows X and Y in FIG. 8, as the rotation speed of the cylinder block 40 increases, the position where the oil amount in the pad region 57 is minimized tends to shift to the "−" side of the inclination angle. Therefore, as a condition for inclining the pad oil grooves 58 and 581 without mutual interference, in a case where the cylinder block 40 rotates at a relatively low speed, it is preferable to set to be in a range on the left side of −10° in FIG. 8. Further, when the cylinder block 40 rotates at a relatively high speed, it is preferable to set the inclination angle of the pad oil grooves 58 and 581 so as to be in a range on the right side of +5° in FIG. 8.

Figure 9:
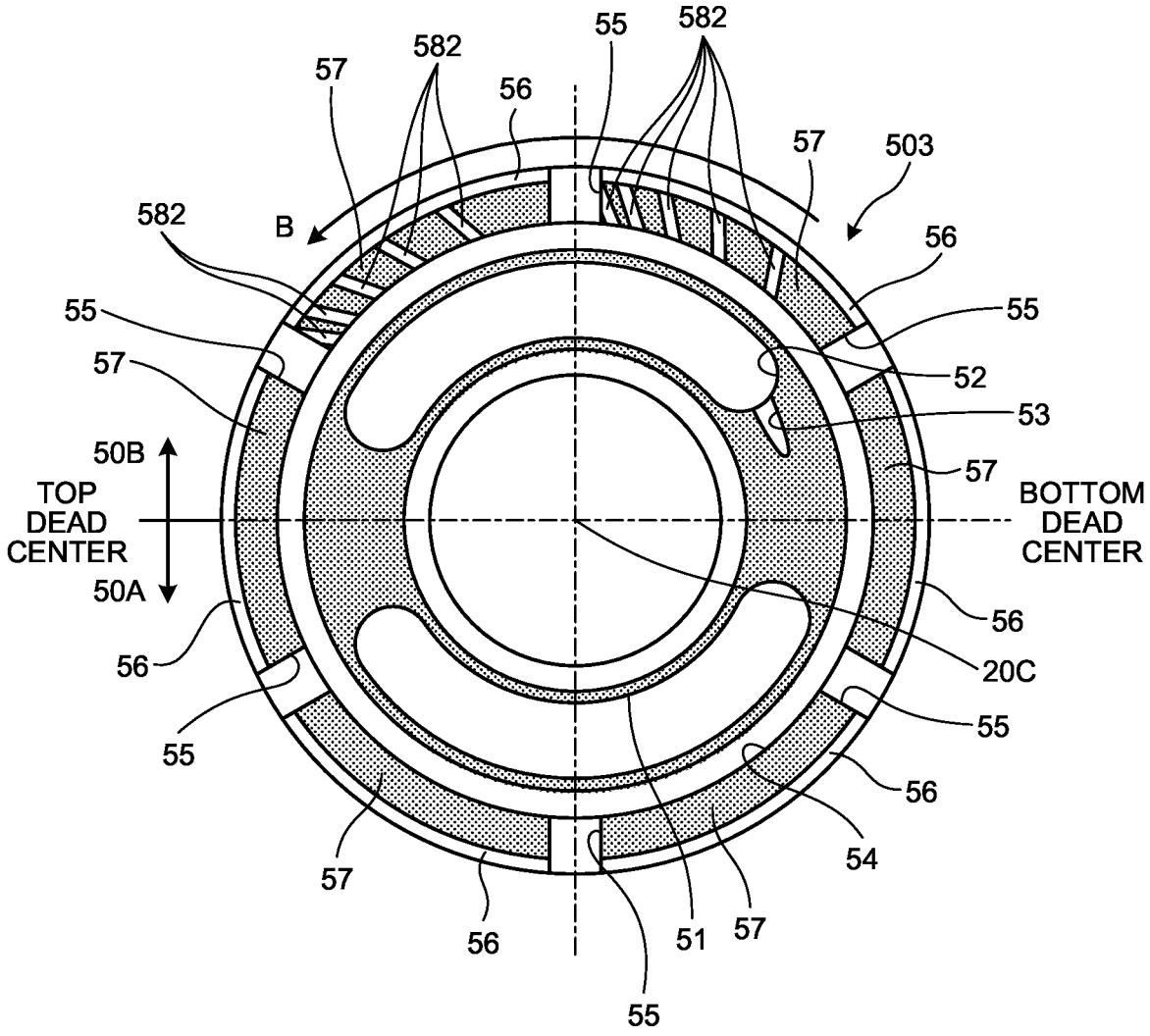
FIG. 9 is an end face diagram of a valve plate of a third modification.
Figure 10:
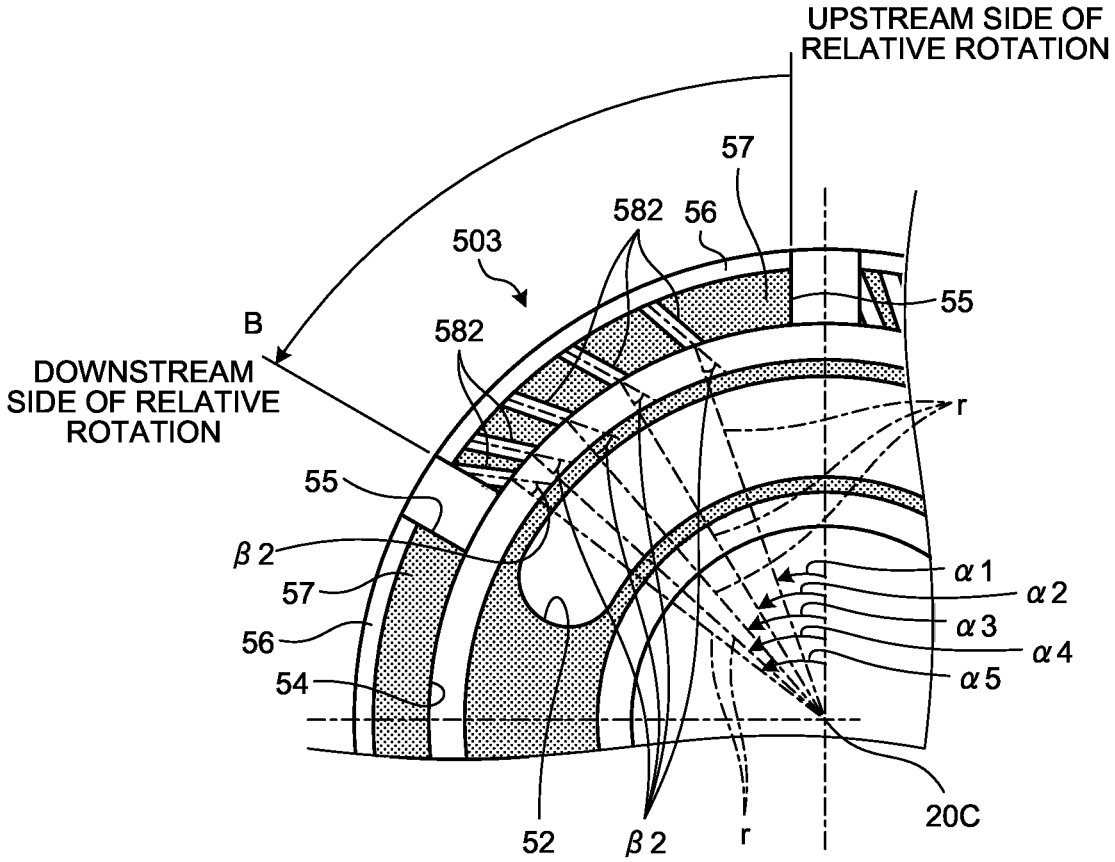
FIG. 10 is an enlarged diagram of a main part of the valve plate illustrated in FIG. 9.
Figure 11:
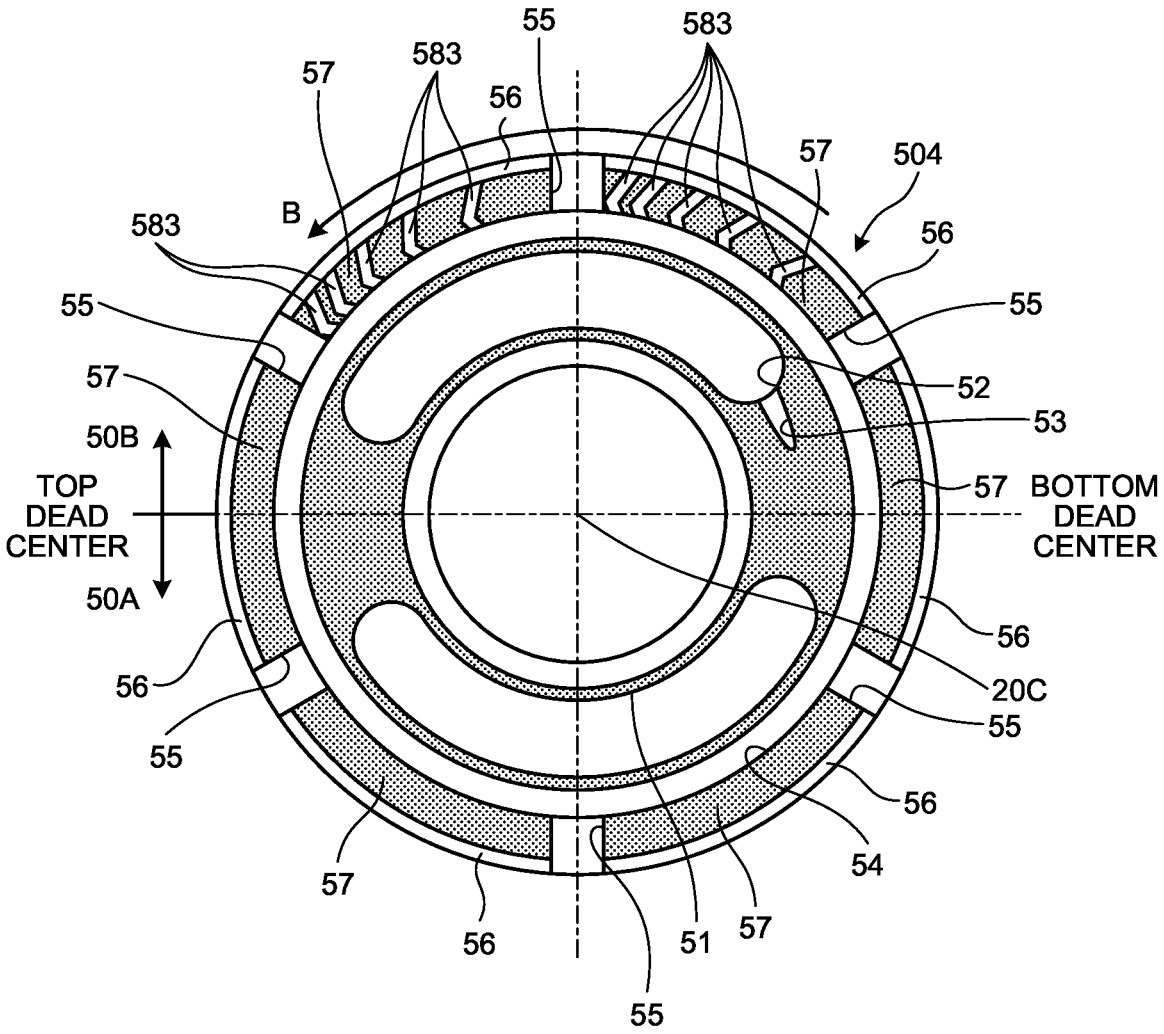
FIG. 11 is an end face diagram of a valve plate of a fourth modification.
Figure 12:
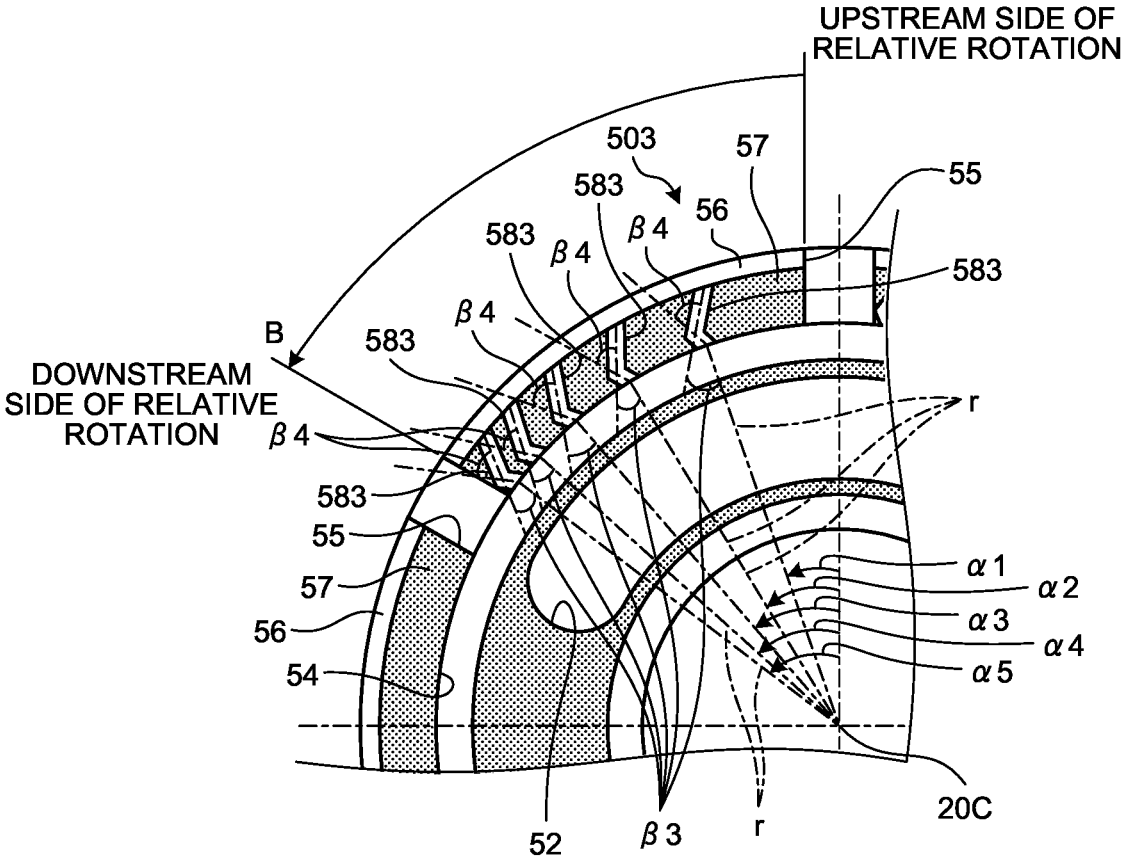
FIG. 12 is an enlarged diagram of a main part of the valve plate illustrated in FIG. 11.

Further, in each of the first embodiment, the first modification, and the second modification described above, the outer peripheral side end of the pad oil grooves 58 and 581 is closed, but the present disclosure is not limited thereto, and it be configured as in a third modification illustrated in FIGS. 9 and 10 or a fourth modification illustrated in FIGS. 11 and 12.

That is, in a valve plate 503 of the third modification illustrated in FIGS. 9 and 10, an outer peripheral side end of pad oil grooves 582 is opened to the outer peripheral surface of the valve plate 503, similarly to the radial oil grooves 55. Inclination angles β2 of the pad oil grooves 582 with respect to the radial r direction about the rotation axis 20C are about +30°. The pitch at which the pad oil grooves 582 are formed is similar to that in the first embodiment. According to the third modification, since the outer peripheral side end of the pad oil grooves 582 is opened, the supply of the oil from the annular oil groove 54 to the pad oil grooves 582 is promoted even under a condition of relatively low speed rotation, which is advantageous in terms of lubricity. Note that, in the third modification, the same configurations as those of the first embodiment are denoted by the same reference numerals. Further, as in the first embodiment, a dot is provided at a contact part of the valve plate 503 with the cylinder block 40.

In a valve plate 504 of the fourth modification illustrated in FIGS. 11 and 12, an outer peripheral side end of pad oil grooves 583 is opened to the outer peripheral surface of the valve plate 504, and the pad oil grooves 583 are bent in the middle. The inclination angle of the pad oil grooves 583 with respect to the radial r direction about the rotation axis 20C is β3=about +30° at the inner peripheral side portion. Bending angles are β4=about 60° between the inner peripheral side portion and the outer peripheral side portion. The bent position of the pad oil grooves 583 is substantially the same distance from the rotation axis 20C. The pitch at which the pad oil grooves 583 are formed is similar to that in the first embodiment. According to the fourth modification, since the outer peripheral side end of the pad oil grooves 583 is opened, the supply of the oil from the annular oil groove 54 to the pad oil grooves 583 is promoted even under a condition of relatively low speed rotation, which is advantageous in terms of lubricity. Moreover, since the inclination angle of the pad oil grooves 583 is reversed in the middle relative to the radial r direction about the rotation axis 20C, lubricity can be improved in both the case of driving at relatively low speed rotation and the case of driving at relatively high speed rotation. Note that, in the fourth modification, the same configurations as those of the first embodiment are denoted by the same reference numerals. Further, as in the first embodiment, a dot is provided at a contact part of the valve plate 504 with the cylinder block 40.

Second Embodiment

Figure 13A:
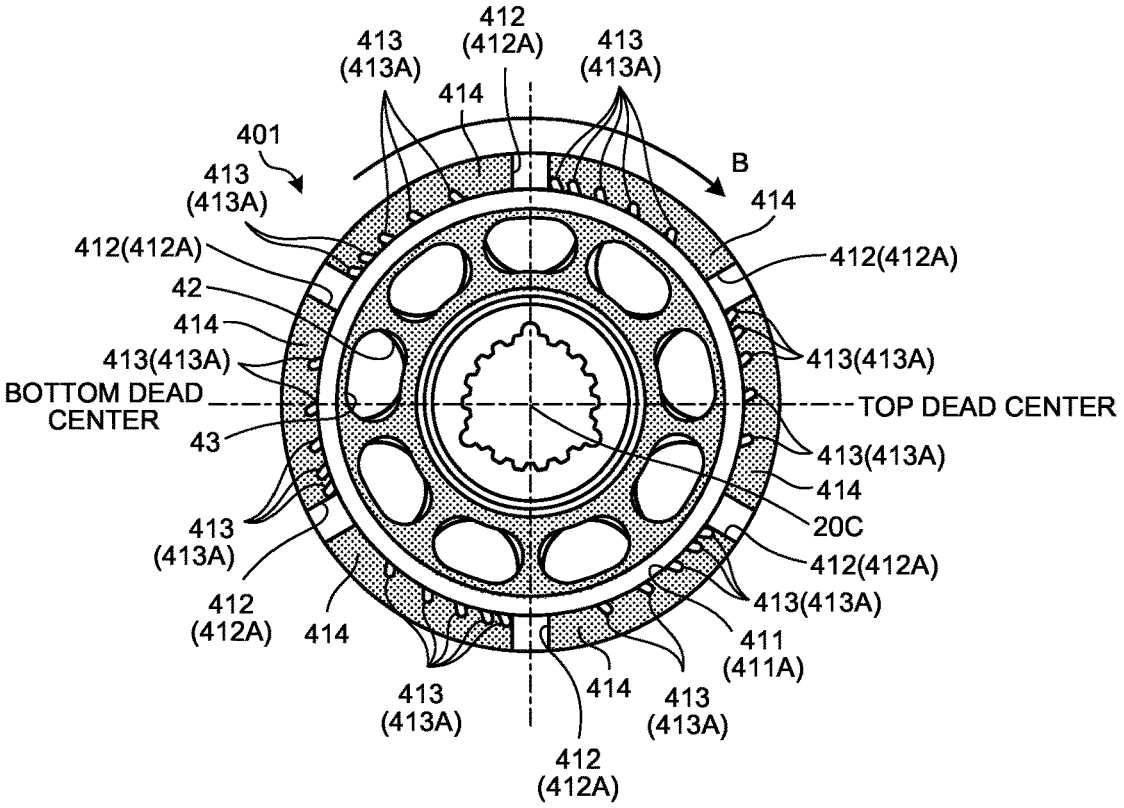
FIG. 13A illustrates components of a hydraulic pump/motor of a second embodiment of the present disclosure, and is an end face diagram of a cylinder block.
Figure 13B:
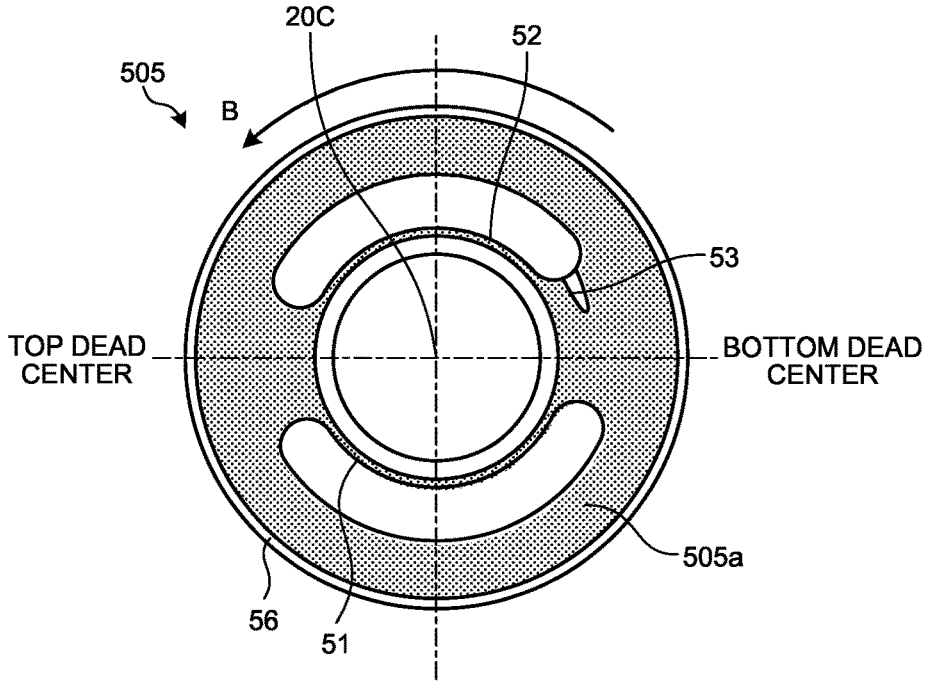
FIG. 13B illustrates components of the hydraulic pump/motor of the second embodiment of the present disclosure, and is an end face diagram illustrating a contact surface of a valve plate with a cylinder block.
Figure 14:
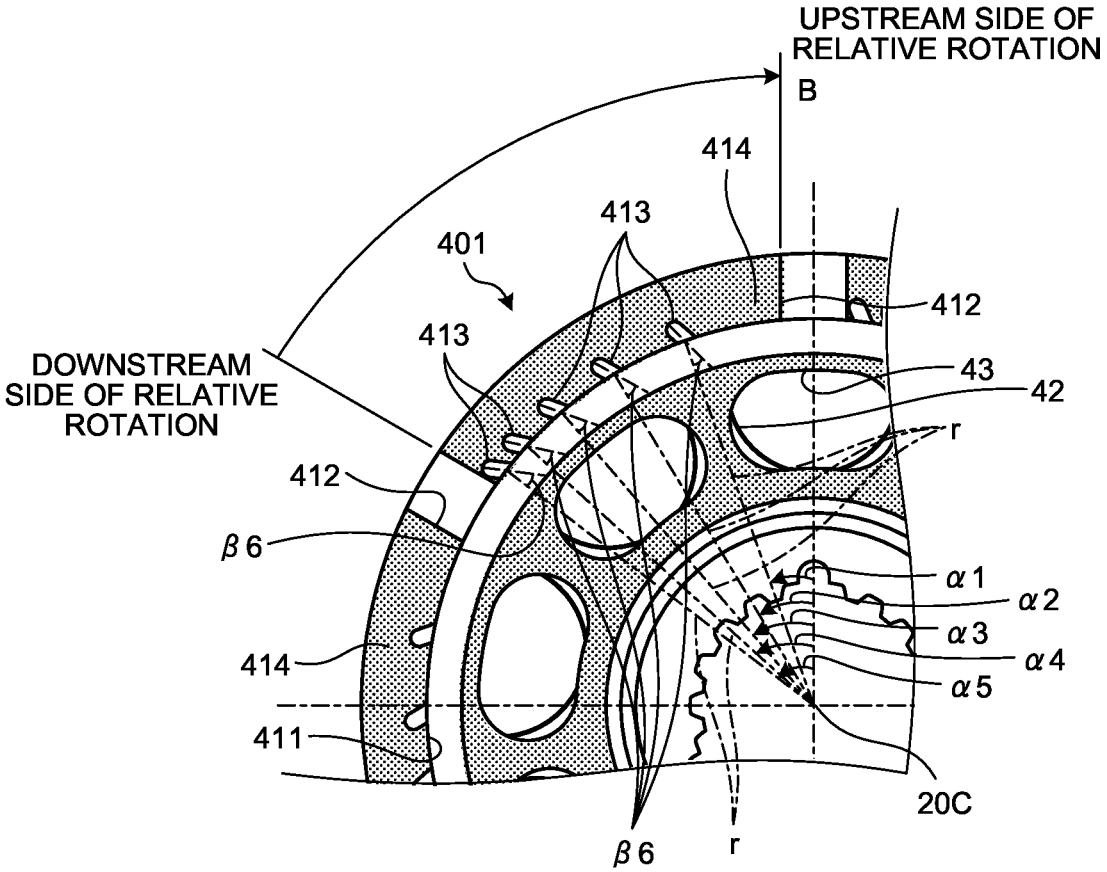
FIG. 14 is an enlarged diagram of a main part of the cylinder block illustrated in FIG. 13A.

FIGS. 13A, 13B, and 14 illustrate a cylinder block 401 and a valve plate 505 applied to a hydraulic pump/motor of the second embodiment of the present disclosure. As in the first embodiment, the cylinder block 401 and the valve plate 505 exemplified here are applied to an axial type that operates as a hydraulic pump when power is given from the outside. The cylinder block 401 and the valve plate 505 of the second embodiment are different from those of the first embodiment in that an annular oil groove (first oil groove) 411, radial oil grooves (second oil grooves) 412, and pad oil grooves 413 are formed in the cylinder block 401. Hereinafter, portions different from those of the first embodiment will be described, and the same reference numerals will be given to common configurations, and detailed description thereof will be omitted. Note that, in the drawings, for the sake of convenience, a dot is provided at a contact part between the cylinder block 401 and the valve plate 505.

As illustrated in FIG. 13B, in the second embodiment, the valve plate 505 is provided with a suction port 51, a discharge port 52, and a notch 53, and an outermost peripheral groove 56 is provided in the outermost peripheral portion.

On the other hand, as illustrated in FIG. 13A, the cylinder block 401 is provided with the annular oil groove 411 and the plurality of radial oil grooves 412. The annular oil groove 411 is an endless annular recess provided in an outer peripheral portion with respect to the communication ports 43 of the cylinder bores 42. The annular oil groove 411 has, for example, a substantially semicircular cross section with a constant radius, and is open only on a surface facing an end face 505*a* of the valve plate 505. The radial oil grooves 412 are linear recesses extending from the annular oil groove 411 toward the outer periphery, and are formed at equal interval positions along the circumferential direction. The radial oil grooves 412 have, for example, a substantially semicircular cross section with a constant radius, are open on a surface facing the end face 505*a* of the valve plate 505, and have outer peripheral side ends open on the outer peripheral surface of the cylinder block 401. In the present second embodiment, the six radial oil grooves 412 are formed radially along the radial r direction about the rotation axis 20C in an outer peripheral side portion with respect to the annular oil groove 411.

Further, in the cylinder block 401, the pad oil grooves 413 are provided in a pad region 414 formed between the radial oil grooves 412 in an outer peripheral portion with respect to the annular oil groove 411. The pad oil grooves 413 are linear recesses having one end communicating with the annular oil groove 411 and the other end closed, and a plurality of pad oil grooves 413 is formed in each of the six pad regions 414. The pad oil grooves 413 have, for example, a substantially semicircular cross section with a constant radius, and are open on a surface facing the end face 505*a* of the valve plate 505. The width of the pad oil groove 413 is smaller than that of the radial oil groove 412. The length of the pad oil groove 413 is provided between the annular oil groove 411 and a portion that is approximately ½ of the dimension along the radial direction of the pad region 414. As is clear from the drawings, the plurality of pad oil grooves 413 is arranged at unequal pitches such that a mutual interval gradually decreases toward the downstream side in the case of the rotation of the cylinder block 401.

Specifically, in the example of FIG. 13A, the pad oil groove 413 is arranged at a total of five positions of $\alpha 1$=about 18.1°, $\alpha 2$=about 30.1°, $\alpha 3$=about 39.6°, $\alpha 4$=about 46.8°, and $\alpha 5$=about 51.6° from the radial oil groove 412 located on the upstream side of the relative rotation with the valve plate 505 with respect to the pad region 414. Thus, the proportion of the opening area of the pad oil groove 413 to the end face 505*a* of the valve plate 505 is larger in the portion on the downstream side than in the portion on the upstream side in the case of the rotation of the cylinder block 401.

Furthermore, each of the pad oil grooves 413 is inclined with respect to the radial r direction about the rotation axis 20C. In the illustrated example, the pad oil grooves 413 are inclined so as to be on the downstream side of the rotation gradually toward the outer periphery. Inclination angles $\beta 6$ of the pad oil grooves 413 are the same as each other, and are set to about 30° with respect to the radial r direction about the rotation axis 20C.

In the hydraulic pump configured as described above, the end face of the cylinder block 401 contacts the valve plate 505, so that the annular oil groove 411 constitutes an endless annular oil passage 411A with respect to the valve plate 505. Similarly, a plurality of radial oil passages 412A opened from the endless annular oil passage 411A to the housing chamber 13 is formed with respect to the valve plate 505 by the radial oil grooves 412. Therefore, while the cylinder block 401 is rotating, the oil leaking from the communication ports 43 lubricates between the cylinder block 401 and the valve plate 505, and is then discharged to the housing chamber 13 via the endless annular oil passage 411A and the radial oil passages 412A. Further, a part of the oil passing through the radial oil passages 412A reaches the pad region 414 as a result of the rotation of the cylinder block 401 and lubricates between the cylinder block 401 and the valve plate 505. Therefore, a sufficient oil film can be secured in an inner peripheral side portion with respect to the endless annular oil passage 411A and a portion close to the radial oil passages 412A on the upstream side of the relative rotation in the pad region 414, and there is no possibility that problems such as seizure and galling due to oil shortage occur.

On the other hand, the oil from the radial oil passages 412A hardly reaches the portion on the downstream side of the relative rotation in the pad region 414, and it is difficult to sufficiently secure the oil film only by the oil passing through the radial oil passages 412A. However, in the above-described hydraulic pump, the pad oil grooves 413 are provided in a portion on the downstream side of the relative rotation in the pad region 414. When the cylinder block 401 contacts the valve plate 505, the pad oil grooves 413 constitute pad oil passages 413A that communicate the endless annular oil passage 411A with the portion on the downstream side of the relative rotation in the pad region 414. Thus, the oil in the endless annular oil passage 411A is supplied to the portion on the downstream side of the relative rotation in the pad region 414 through the pad oil passages 413A. Therefore, even when the hydraulic pump is increased in pressure and speed, there is no possibility of causing oil shortage, and there is no concern that problems such as seizure and galling occur. Moreover, the pad oil grooves 413 are provided in the pad region 414 which the outer peripheral portion of the cylinder block 401 contacts such that the proportion of the opening area to the end face 505*a* of the valve plate 505 is larger on the downstream side than on the upstream side of the relative rotation. For this reason, it is possible to secure a contact part with the valve plate 505 in a portion on the upstream side of the relative rotation in the pad region 414. As a result, there is no concern that the rotation of the cylinder block 401 becomes unstable due to the provision of the pad oil grooves 413, and high pressure and high speed of the hydraulic pump can be realized.

Note that, in the second embodiment described above, nine cylinder bores 42 are provided in the cylinder block 401, and six radial oil grooves 412 are linearly provided as an example, but the number of cylinder bores 42 and the shape and number of radial oil grooves 412 are not limited to those of the second embodiment.

Further, in the second embodiment described above, the pad oil grooves 413 are also provided in a portion on the upstream side of the relative rotation with respect to an intermediate position in the circumferential direction in the pad region 414, but the present disclosure is not limited thereto, and it is sufficient that the pad oil grooves 413 are provided only in the portion on the downstream side of the relative rotation with respect to the intermediate position in the circumferential direction in the pad region 414.

Figure 15:
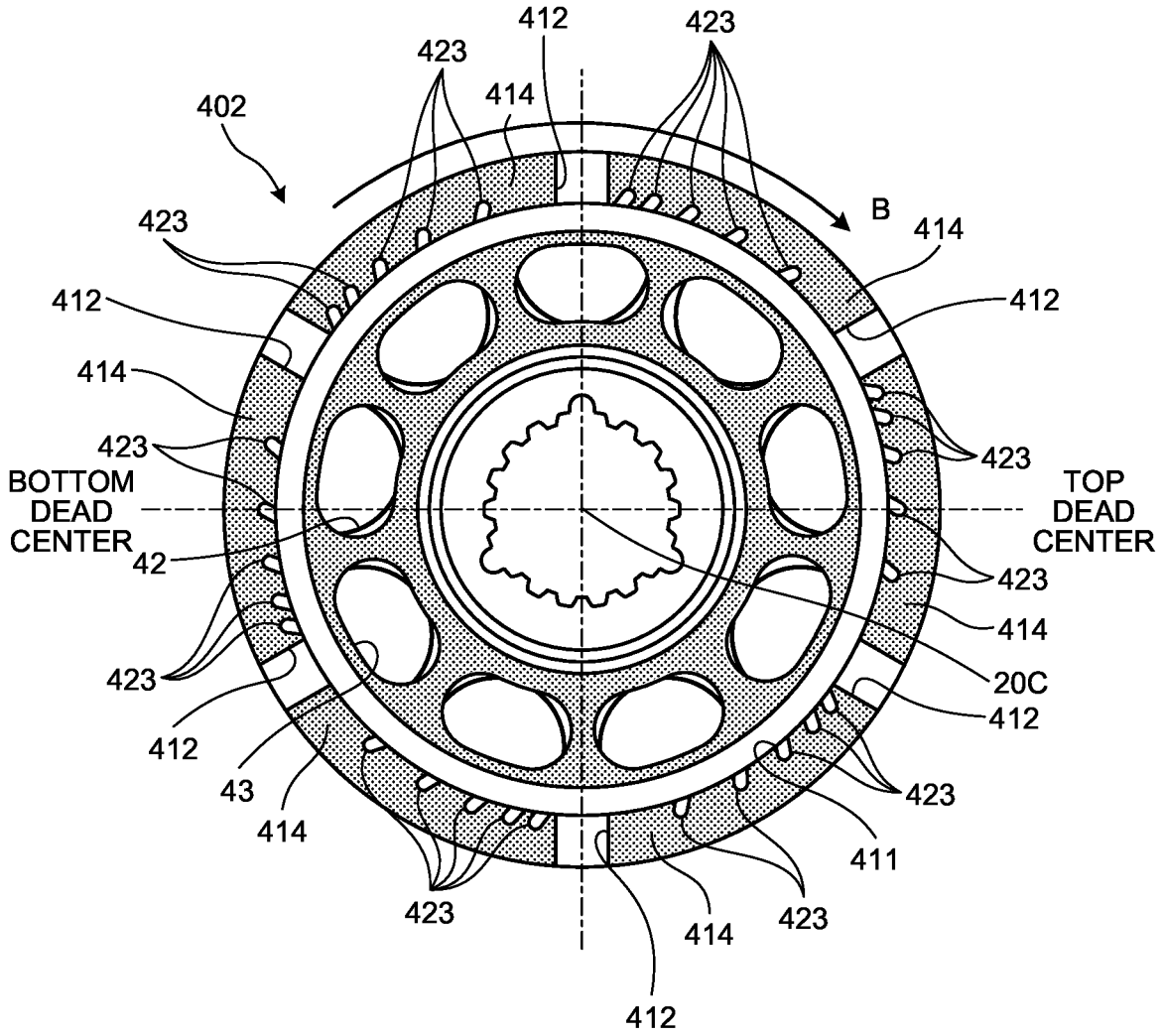
FIG. 15 is an end face diagram of a cylinder block of a fifth modification.
Figure 16:
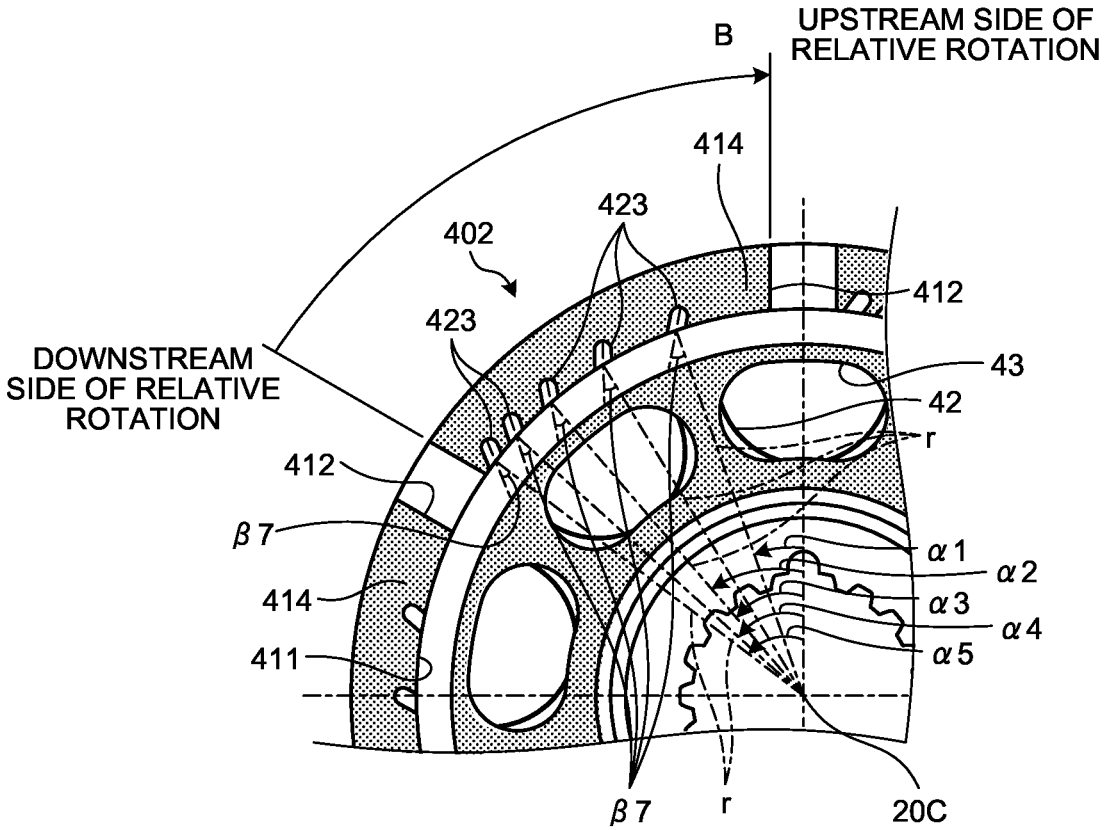
FIG. 16 is an enlarged diagram of a main part of the cylinder block illustrated in FIG. 15.

Furthermore, in the above-described second embodiment, the pad oil grooves 413 are inclined with respect to the radial r direction about the rotation axis 20C so as to be on the downstream side of the relative rotation gradually toward the outer periphery. However, the pad oil grooves 413 may be provided along the radial r direction about the rotation axis 20C. Further, as in a cylinder block 402 of the fifth modification illustrated in FIGS. 15 and 16, the pad oil grooves 423 may be inclined with respect to the radial r direction about the rotation axis 20C so as to be downstream of the relative rotation gradually toward the outer periphery. Inclination angles β7 of the pad oil grooves 423 with respect to the radial r direction about the rotation axis 20C are about 30° in the direction opposite to that in the second embodiment. Note that, in the fifth modification, the same configurations as those of the second embodiment are denoted by the same reference numerals. Further, as in the second embodiment, a dot is provided at a contact part of the cylinder block 402 with the valve plate 505. Further, it is also possible to apply the pad grooves described as the second to fourth modifications of the first embodiment to the cylinder block.

Furthermore, in the first embodiment, the first to fourth modifications, the second embodiment, and the fifth modification described above, those used as a hydraulic pump are exemplified, but they may be used as a hydraulic motor.

Further, in each of the first embodiment, the first to fourth modifications, the second embodiment, and the fifth modification described above, the annular oil groove and the radial oil grooves are provided in the same member. However, as long as the radial oil grooves and the pad oil grooves are provided in the same member, the annular oil groove and the radial oil grooves may be provided in different members.

Furthermore, by providing the pad oil grooves having the same dimension at unequal pitches, the proportion of the opening area of the pad oil grooves is changed between the upstream side and the downstream side of the relative rotation, but the present disclosure is not limited thereto. For example, it is also possible to change the proportion of the opening area of the pad oil grooves between the upstream side and the downstream side of the relative rotation by providing a plurality of pad oil grooves having different opening widths and a plurality of pad oil grooves having different extension lengths at equal intervals. Further, when the plurality of pad oil grooves is inclined with respect to the radial direction about the rotation axis, the pad oil grooves are inclined at the same angle, but the inclination angles of the plurality of pad oil grooves may be different from each other.

REFERENCE SIGNS LIST

20C ROTATION AXIS
40, 401, 402 CYLINDER BLOCK
40*a* END FACE OF CYLINDER BLOCK
42 CYLINDER BORE
50, 501, 502, 503, 504, 505 VALVE PLATE
51 SUCTION PORT
52 DISCHARGE PORT
54, 411 ANNULAR OIL GROOVE
55, 412 RADIAL OIL GROOVE
57, 414 PAD REGION
58, 413, 423, 581, 582, 583 PAD OIL GROOVE
505*a* END FACE OF VALVE PLATE

The invention claimed is:

1. A valve plate of a hydraulic pump/motor, the valve plate comprising a high pressure-side port and a low pressure-side port on a circumference about a rotation axis, a first oil groove provided to be annular in an outer peripheral part with respect to the high pressure-side port and the low pressure-side port, and a plurality of second oil grooves extending from the first oil groove toward an outer periphery, the high pressure-side port and the low pressure-side port being alternately communicated with a cylinder bore provided in a cylinder block by relative rotation about the rotation axis in a state of being in contact with an end face of the cylinder block, wherein a plurality of pad oil grooves communicating with the first oil groove and opened toward the end face of the cylinder block are provided in an outer peripheral portion of the high pressure-side port, at least in a portion being on a downstream side of the relative rotation, in a pad region contacting the end face of the cylinder block between the second oil grooves, and wherein the plurality of pad oil grooves are provided such that a proportion of an opening area to the end face of the cylinder block is larger on the downstream side than on an upstream side of the relative rotation.

2. The valve plate according to claim 1, wherein the plurality of pad oil grooves extend linearly and are inclined with respect to a radial direction about the rotation axis.

3. The valve plate according to claim 2, wherein the plurality of pad oil grooves are inclined in a same direction with respect to the radial direction.

4. The valve plate according to claim 1, wherein the plurality of pad oil grooves are provided only in the portion on the downstream side of the relative rotation in the pad region.

5. The valve plate according to claim 1, wherein the plurality of pad oil grooves have a same extension length from the first oil groove and a same opening width with respect to the end face of the cylinder block, and are provided at unequal pitches such that a mutual interval gradually decreases to the downstream side of the relative rotation.

6. The valve plate according to claim 1, wherein outer peripheral side ends of the plurality of pad oil grooves are closed.

7. A hydraulic pump/motor comprising the valve plate according to claim 1.

8. A cylinder block of a hydraulic pump/motor, the cylinder block comprising a plurality of cylinder bores around a rotation axis, a first oil groove provided to be annular in an outer peripheral part with respect to the cylinder bores on an end face where the plurality of cylinder bores is opened, and a plurality of second oil grooves extending from the first oil groove toward an outer periphery, the plurality of cylinder bores being alternately communicated with a high pressure-side port and a low pressure-side port provided in a valve plate by relative rotation in a state where the end face is in contact with the valve plate, wherein a plurality of pad oil grooves communicating with the first oil groove and opening toward the valve plate are provided at least in a portion on a downstream side of the relative rotation in a pad region contacting the valve plate between the second oil grooves, and wherein the plurality of pad oil grooves are provided such that a proportion of an opening area with respect to the valve plate is larger on the downstream side of the relative rotation than on an upstream side of the relative rotation.

9. The cylinder block according to claim 8, wherein the plurality of pad oil grooves extend linearly and are inclined with respect to a radial direction about the rotation axis.

10. The cylinder block according to claim 9, wherein the plurality of pad oil grooves are inclined in a same direction with respect to the radial direction.

11. The cylinder block according to claim 8, wherein the plurality of pad oil grooves are provided only in the portion on the downstream side of the relative rotation in the pad region.

12. The cylinder block according to claim 8, wherein the plurality of pad oil grooves have a same extension length from the first oil groove and a same opening width with respect to the end face of the valve plate, and are provided at unequal pitches such that a mutual interval gradually decreases to the downstream side of the relative rotation.

13. The cylinder block according to claim 8, wherein outer peripheral side ends of the plurality of pad oil grooves are closed.

14. A hydraulic pump/motor comprising the cylinder block according to claim 8.

* * * * *